US008584455B2

(12) United States Patent
Tai et al.

(10) Patent No.: US 8,584,455 B2
(45) Date of Patent: Nov. 19, 2013

(54) HEATING AND COOLING DEVICE

(75) Inventors: Chang-Hsien Tai, Pingtung (TW); Uzu-Kuei Hsu, Pingtung (TW); Jr-Ming Miao, Pingtung (TW); Geng-Ren Liu, Pingtung (TW)

(73) Assignee: National Pintung University of Science & Technology, Neipu Hsiang, Pingtung County (TW)

( * ) Notice: Subject to any disclaimer, the term of this patent is extended or adjusted under 35 U.S.C. 154(b) by 0 days.

(21) Appl. No.: 13/608,306

(22) Filed: Sep. 10, 2012

(65) Prior Publication Data

US 2013/0152606 A1 Jun. 20, 2013

(30) Foreign Application Priority Data

Dec. 19, 2011 (TW) ..... 100147168 A

(51) Int. Cl.
*F02G 1/043* (2006.01)
*F02G 1/055* (2006.01)
*F02G 1/044* (2006.01)

(52) U.S. Cl.
USPC ..... 60/517

(58) Field of Classification Search
USPC ..... 60/516–526; 74/57; 92/31–33
See application file for complete search history.

(56) References Cited

U.S. PATENT DOCUMENTS

| | | | | |
|---|---|---|---|---|
| 11,696 | A * | 9/1854 | Napier | 60/526 |
| 1,813,763 | A * | 7/1931 | Price | 91/197 |
| 5,515,683 | A | 5/1996 | Kessler | |
| 5,970,719 | A | 10/1999 | Merritt | |
| 6,446,434 | B1 * | 9/2002 | Lin et al. | 60/508 |
| 6,532,749 | B2 | 3/2003 | Rudick et al. | |
| 2004/0050044 | A1 * | 3/2004 | Ogura | 60/517 |
| 2008/0282694 | A1 * | 11/2008 | Kitamura et al. | 60/517 |
| 2009/0255249 | A1 * | 10/2009 | Hoffman et al. | 60/520 |
| 2011/0259188 | A1 * | 10/2011 | Jairam | 92/31 |

* cited by examiner

*Primary Examiner* — Thomas Denion
*Assistant Examiner* — Brian Inacay
(74) *Attorney, Agent, or Firm* — Muncy, Geissler, Olds & Lowe, PLLC

(57) ABSTRACT

A heating and cooling device includes a cylinder having a chamber for receiving a gas. A guiding groove is defined in an inner periphery of the chamber. A piston assembly is movably received in the chamber of the cylinder. The piston assembly includes first and second pistons and a connecting rod connected to the first and second pistons. The first piston is mounted to a side of the second piston and rotatable relative to the connecting rod. Each of the first and second pistons includes a plurality of openings. A guiding block is formed on an outer periphery of the first piston and is slideably received in the guiding groove.

7 Claims, 5 Drawing Sheets

HEATING AND COOLING DEVICE

BACKGROUND OF THE INVENTION

1. Field of the Invention

The present invention relates to a heating and cooling device and, more particularly, to a heating and cooling device producing a high-temperature gas and a low-temperature gas by moving a piston assembly.

2. Description of the Related Art

Sterling engines not using fuels have been widely used due to environment-friendly and energy-saving concepts. A Sterling engine generally includes a cylinder, a displacer slideably received in the cylinder, and a crankshaft connected to the displacer. The crankshaft is driven by the displacer to output power. Due to heat expansion and cold shrinkage of the gas in the cylinder, the displacer reciprocates in the cylinder and drives the crankshaft to output power. Thus, the Sterling engine absorbs and releases heat by using a temperature difference that is converted into the work to be outputted, achieving the power output purposes.

However, an external heat source is required to increase the temperature of the gas in the cylinder, and the time for starting a conventional Sterling engine is relatively long, increasing the costs and time for operation. Furthermore, the temperature changes of the gas in the cylinder are apt to affect each other, failing to effectively maintain a better temperature difference during long-term alternating heating and cooling operations. Further, the period of time of heating or cooling must be extended to reuse the heat by absorption and release for converting the heat into the work to be outputted. Thus, the operation of the conventional Sterling engine is slow and fails to provide better work output efficiency in a short period of time.

Thus, a need exists for a heating and cooling device that can rapidly produce a high-temperature gas and a low-temperature gas to effectively maintain a better temperature difference, solving the above disadvantages.

SUMMARY OF THE INVENTION

An objective of the present invention is to provide a heating and cooling device that rapidly heats and cools two portions of a gas to produce a relatively high-temperature gas and a relatively low-temperature gas.

Another objective of the present invention is to provide a heating and cooling device that effectively maintains a better temperature difference for application in a conventional thermodynamic cycling mechanism, increasing the overall operational speed and increasing the work output efficiency of the thermodynamic cycling mechanism.

The present invention fulfills the above objectives by providing a heating and cooling device including a cylinder having a chamber. A guiding groove is defined in an inner periphery of the chamber. The chamber is adapted for receiving a gas. A piston assembly is movably received in the chamber of the cylinder. The piston assembly includes first and second pistons and a connecting rod connected to the first and second pistons. The first piston is mounted to a side of the second piston and rotatable relative to the connecting rod. Each of the first and second pistons includes a plurality of openings. A guiding block is formed on an outer periphery of the first piston and is slideably received in the guiding groove.

In a form shown, the guiding groove is a closed annular groove and includes first and second groove sections. Each of the first and second groove sections includes a transverse section and a transverse section. The transverse section of the first groove section is connected to the longitudinal section of the second groove section. The transverse section of the second groove section is connected to the longitudinal section of the first groove section, with the guiding groove being a parallelogram. The transverse section of the first groove section is at a first angle to the longitudinal section of the first groove section. The transverse section of the second groove section is at a second angle to the longitudinal section of the second groove section, with each of the first and second angles being larger than 90°.

The heating and cooling device can further include a regulating module having first and second regulators mounted to two sides of the cylinder. Each of the first and second regulators includes a conductive portion and an insulating portion. The second regulator includes a notch in the form of an elongated slit extending in a longitudinal direction of the second regulator. The connecting rod moves in the elongated slit while the first and second pistons move in the chamber.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
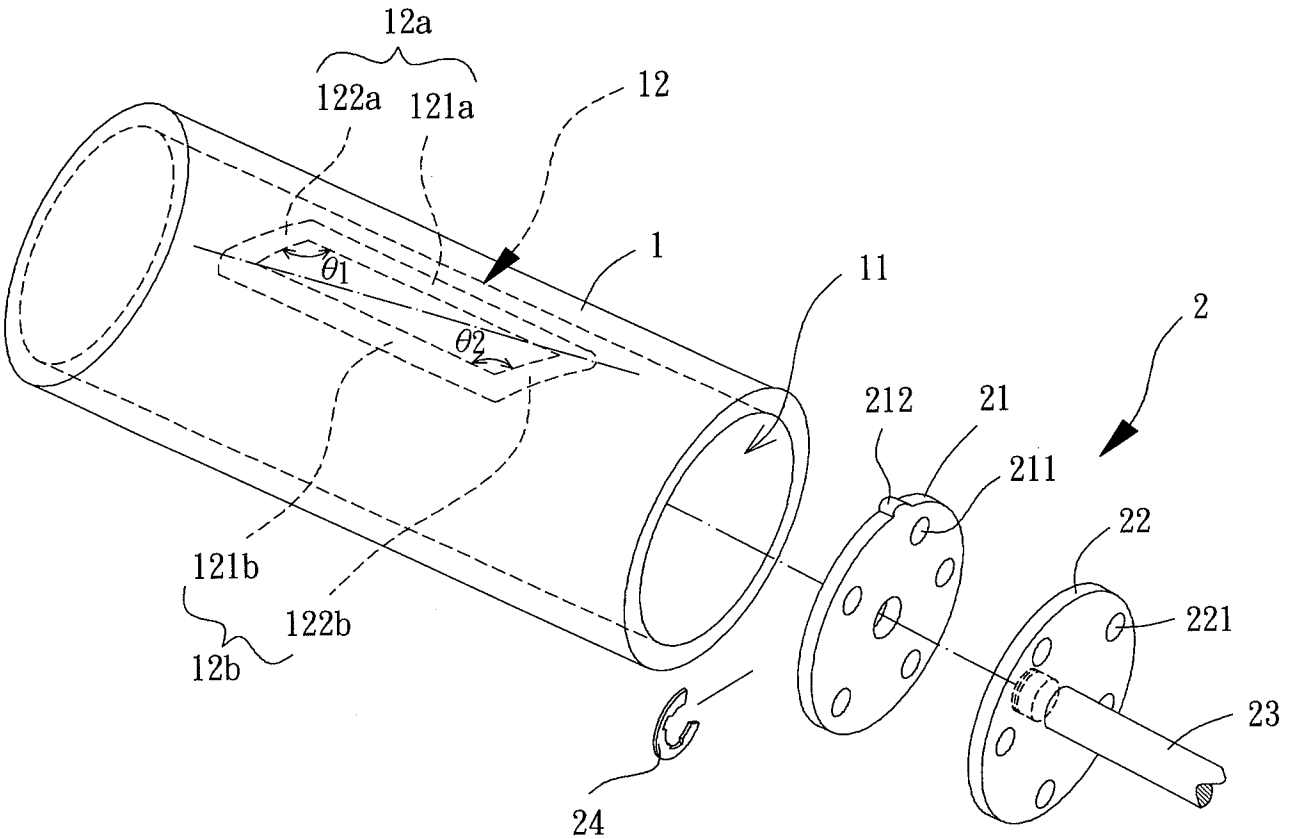
FIG. 1 shows a perspective view of a portion of a heating and cooling device according to the present invention.

A cooling and heating device according to the present invention is used to produce a relatively high-temperature gas and a relatively low-temperature gas for use in a thermodynamic cycling mechanism, such as a Sterling engine, according to needs. FIG. 1 shows a preferred embodiment according to the present invention. The cooling and heating device includes a cylinder 1 and a piston assembly 2 received in the cylinder 1. The term "high temperature" referred to hereinafter means the temperature of the gas is higher than a normal temperature of the gas existing in the air in a normal condition. The term "low temperature" referred to hereinafter means the temperature of the gas is lower than the normal temperature of the gas existing in the air in the normal condition.

The cylinder 1 includes a chamber 11 into which a gas is filled, with the shape and size of the chamber 11 suitable for reciprocating movement of the piston assembly 2. In this embodiment, two ends of the cylinder 1 are closed to provide a sealing state, allowing the gas to accomplish shrinkage and expansion operations in the cylinder 1. Specifically, the cylinder 1 can be a cylinder or cuboid, and the chamber 11 can include rectangular cross sections to prolong the route of the reciprocating movement of the piston assembly 2, providing enhanced shrinkage and expansion effects of the gas.

The cylinder 1 further includes a guiding groove 12 defined in an inner periphery of the cylinder 1, with the guiding groove 12 being a closed annular groove for guiding movement of the piston assembly 2 in the cylinder 1. In this embodiment, the guiding groove 12 includes a first groove section 12*a* and a second groove section 12*b*, with the first and second groove sections 12*a* and 12*b* together forming the closed annular groove. Each of the first and second groove sections 12*a* and 12*b* includes a longitudinal section 121*a*, 121*b* and a transverse section 122*a*, 122*b*. Preferably, each longitudinal section 121*a*, 121*b* extends in a direction parallel to a longitudinal axis of the cylinder 1. The transverse section 122*a* of the first groove section 12*a* is connected to the longitudinal section 121*b* of the second groove section 12*b*. The transverse section 122*b* of the second groove section 12*b* is connected to the longitudinal section 121*a* of the first groove section 12*a*. Thus, the guiding groove 12 is in the form of a parallelogram in this embodiment. The longitudinal section 121*a* of the first groove section 12*a* is at a first angle θ1 to the transverse section 122*a* of the first groove section 12*a*, and the longitudinal section 121*b* of the second groove section 12*b* is at a second angle θ2 to the transverse section 122*b* of the second groove section 12*b*. Each of the first and second angles θ1 and θ2 is preferably larger than 90°. Thus, each transverse section 122*a*, 122*b* is an inclined groove allowing the piston assembly 2 to smoothly move from the longitudinal section 121*a*, 121*b* into the transverse section 122*a*, 122*b* by provision of the first and second angles θ1 and θ2. Further, an interconnection of each longitudinal section 121*a*, 121*b* and each transverse section 122*a*, 122*b* is preferably arcuate, enhancing smoothness of the piston assembly 2 while moving between the longitudinal sections 121*a*, 121*b* and the transverse sections 122*a*, 122*b*.

Figure 2:
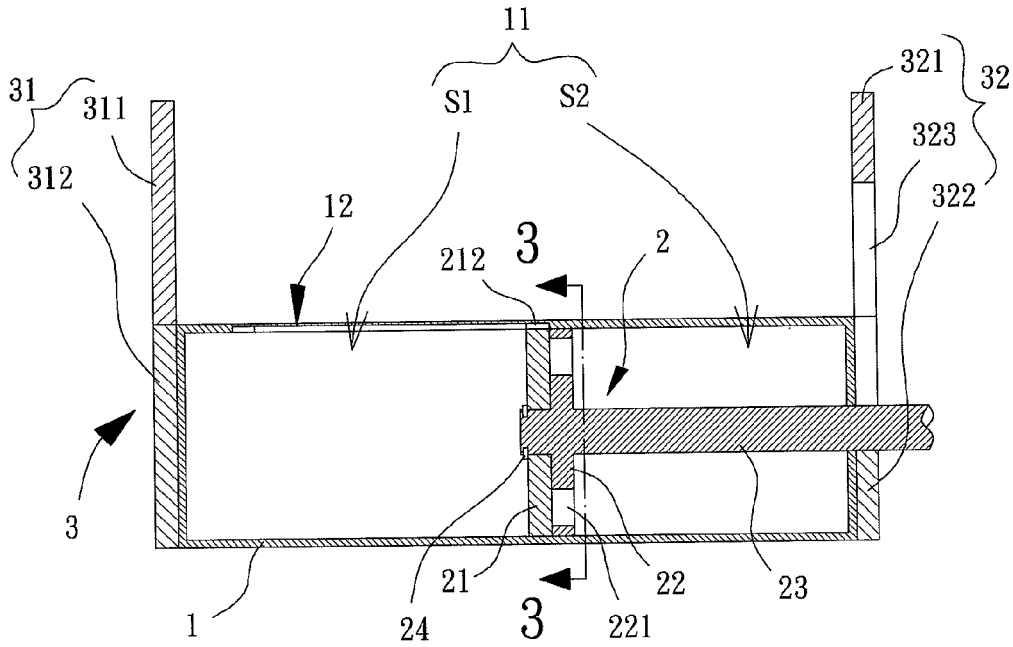
FIG. 2 shows a cross sectional view of the heating and cooling device according to the present invention.

With reference to FIGS. 1 and 2, the piston assembly 2 reciprocates in the cylinder 1 and divides the chamber 11 of the cylinder 1 into a compression section S1 and an expansion section S2. The piston assembly 2 includes a first piston 21 and a second piston 22, with the first piston 21 rotatably mounted to a side of the second piston 22. Each of the first and second pistons 21 and 22 includes a plurality of openings 211, 221. Alignment between the openings 211 and 221 is controlled by rotation of the first piston 21 relative to the second piston 22. In this embodiment, the first piston 21 further includes a guiding block 212 formed on an outer periphery thereof. The guiding block 212 is slideable along the guiding groove 12. Preferably, the guiding block 212 is arcuate such that the guiding block 212 can smoothly slide in the guiding groove 12. Furthermore, each of the first and second pistons 22 can be in the form of a disc, with the first and second pistons 22 having an identical diameter. However, other arrangements of the first and second pistons 22 can be used to allow rotation of the first piston 21 relative to the second piston 22.

In this embodiment, the piston 2 further includes a connecting rod 23 connected to the first and second pistons 21 and 22 such that the first piston 21 is mounted to a side of the second piston 22 and rotatable relative to the connecting rod 23 and that the second piston 22 is not movable relative to the connecting rod 23. Alternatively, the connecting rod 23 can be integrally formed with the second piston 22. In this embodiment, the connecting rod 23 extends through the second piston 22 and has an end located outside of the second piston 22 for rotational engagement with the first piston 21. The other end of the connecting rod 23 extends out of the cylinder 1 and is connected to and driven by a driving member. The first and second pistons 22 are also moved when the connecting rod 23 is driven by the driving member. Furthermore, a retainer 24 is provided to retain the first piston 21, avoiding the first piston 21 from becoming loosened relative to the connecting rod 23.

Still referring to FIG. 2, the heating and cooling device according to the present invention can further include a regulating module 3 having first and second regulators 31 and 32. The first and second regulators 31 and 32 are respectively and movably mounted to two sides of the cylinder 1 to transmit the heat and cold produced by the present invention to a conventional thermodynamic cycling mechanism for energy-saving purposes.

In this embodiment, each of the first and second regulators 31 and 32 includes a conductive portion 311, 321 and an insulating portion 312, 322. The conductive portions 311 and 321 of the first and second regulators 31 and 32 respectively transmit the heat produced by compression of a portion of the gas and the cold produced by expansion of another portion of the gas. The insulating portions 312 and 322 avoid interference from the ambient air temperature, maintaining a better temperature difference in the compression section S1 and the expansion section S2. The second regulator 32 further includes a notch 323 through which the connecting rod 23 of the piston assembly 2 extends. The notch 323 can be in the form of an elongated slit extending in a longitudinal direction of the second regulator 32. Thus, the connecting rod 23 moves in the elongated slit while the first and second pistons 21 and 22 are moving in the chamber 11. The first and second regulators 31 and 32 can move upward and downward on two sides of the cylinder 1 by using a driving mechanism, such as a camshaft, which can be appreciated by one skilled in the art.

Figure 3:
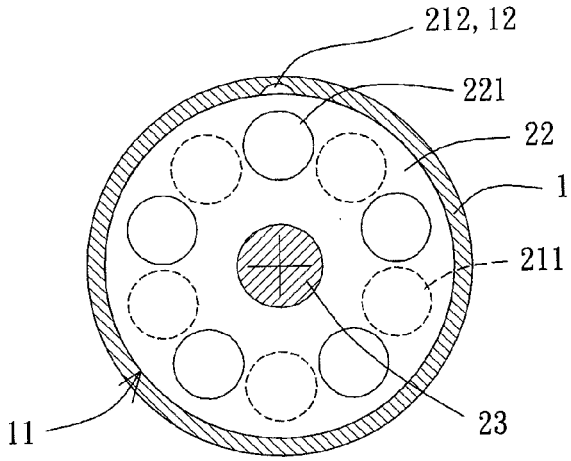
FIG. 3 shows a cross sectional view taken along section line 3-3 of FIG. 2.

Operation of the heating and cooling device according to the present invention to produce a high-temperature gas and a low-temperature gas for use in a thermodynamic cycling mechanism (such as a Sterling engine) will now be described. Referring firstly to FIGS. 2 and 3, the gas filled into the chamber 11 before movement of the piston 2 is divided by the first and second pistons 21 and 22, with the gas portion in the compression section S1 isolated from the gas portion in the expansion section S2. Furthermore, the guiding block 213 of the first piston 21 is initially at a starting end of the first groove section 12*a* of the groove 12 (i.e., the interconnection of the longitudinal section 121*a* of the first groove section 12*a* and the transverse section 122*b* of the second groove section 12*b*. In this state, the openings 211 of the first piston 21 are misaligned from the openings 221 of the second portion 22. Thus, the compression section S1 and the expansion section S2 are isolated from each other, with the gas temperature in the compression section S1 identical to the gas temperature in the expansion section S2.

Figure 4:
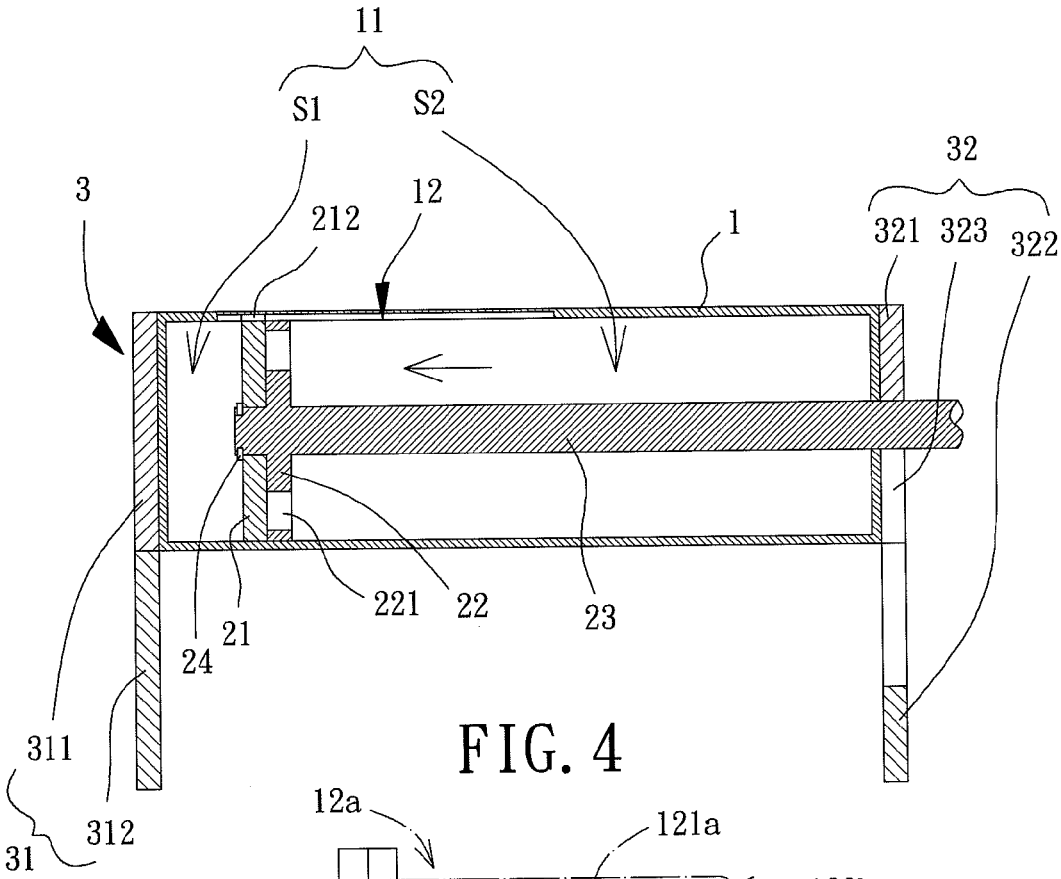
FIG. 4 is a cross sectional view similar to FIG. 2, with a compression section of a chamber of a cylinder compressed, with an expansion section of the chamber expanded.
Figure 5:
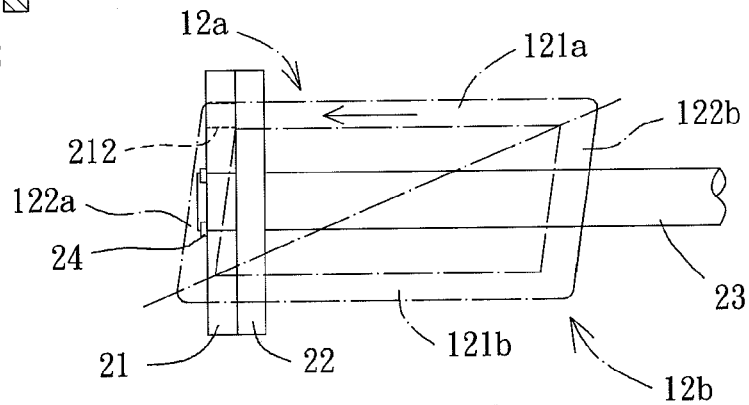
FIG. 5 shows a schematic view of a piston assembly and a guiding groove in the cylinder, with first and second pistons of the piston assembly moved in a longitudinal section of the guiding groove.

Refer now to FIGS. 4 and 5. When the piston assembly 2 moves in a direction indicated by the arrow in FIG. 4, the first and second pistons 21 and 22 move synchronously to a left end of the cylinder 1 shown in FIG. 4 while the guiding block 213 moves along the longitudinal section 121*a* of the first groove section 12*a*, the gas portion in the compression section S1 is compressed by the piston assembly 2, resulting in an increase in the gas temperature in the smaller space. On the other hand, the gas portion in the expansion section S2 expands due to movement of the piston assembly 2 away from the second regulator 32, resulting in a reduction in the gas temperature in the expansion section S2. The first and second regulators 31 and 32 are moved to a position in which the conductive portions 311 and 321 of the first and second regulators 31 and 32 respectively abut two sides of the cylinder 1, transmitting the heat produced by the high-temperature gas and transmitting the cold produced by the low-temperature gas from two sides of the cylinder 1. In application in a conventional thermodynamic cycling mechanism, the heat is used by a boiler to produce water steam, and the cold is used by a cooler to cool the water steam into liquid water, repeating the thermodynamic cycle. The work output efficiency is enhanced, and better power is outputted.

Figure 6:
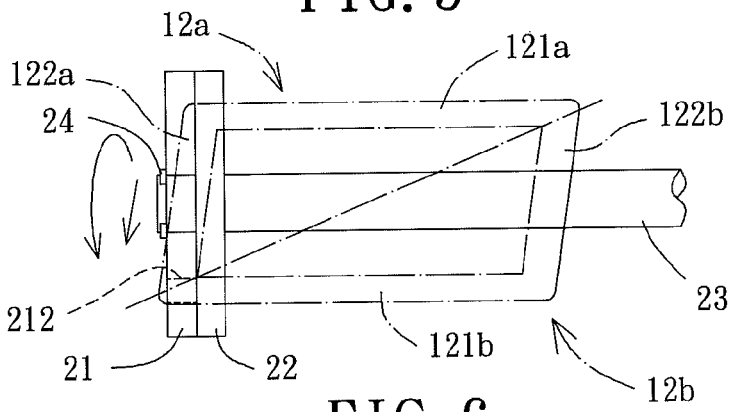
FIG. 6 shows a view similar to FIG. 5, with the second piston of the piston assembly rotated while a guiding block of the first piston moves in a transverse section of the guiding groove.

Note that when the piston assembly 2 moves to the interconnection of the longitudinal section 121*a* and the transverse section 122*a* of the first groove section 12*a* (the left end of the guiding groove 12 in FIG. 5), the guiding block 213 of the first piston 21 slides into the transverse section 122*a* of the first groove section 12*a*, and the first piston 21 rotates while the guiding block 213 moves along the transverse section 122*a* (see the arrow in FIG. 6).

Figure 7:
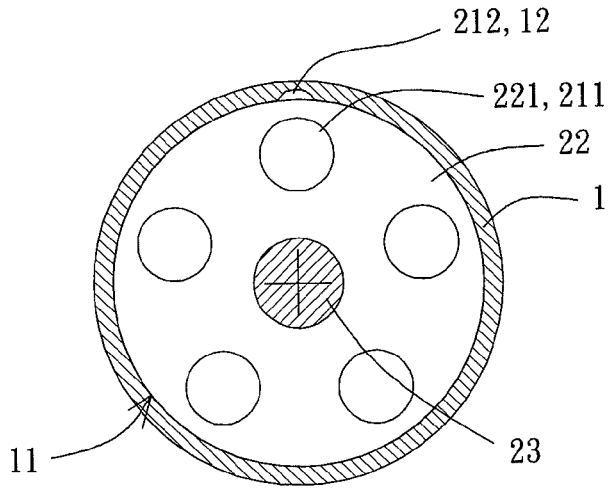
FIG. 7 shows a cross sectional view taken along section line 7-7 of FIG. 8.

When the first piston 21 moves to a starting end of the second groove section 12*b* (i.e., the intersection of the longitudinal section 121*b* of the second groove section 12*b* and the transverse section 122*a* of the first groove section 12*a*), the openings 211 of the first piston 21 are aligned with the openings 221 of the second piston 22 (FIG. 7). Thus, the compression section S1 and the expansion section S2 of the chamber 11 are in communication with each other. At this time, the high-pressure gas portion in the compression section S1 flows into the expansion section S2 via the aligned openings 211 and 221. A pressure balance is instantly reached in the chamber 11.

Figure 8:
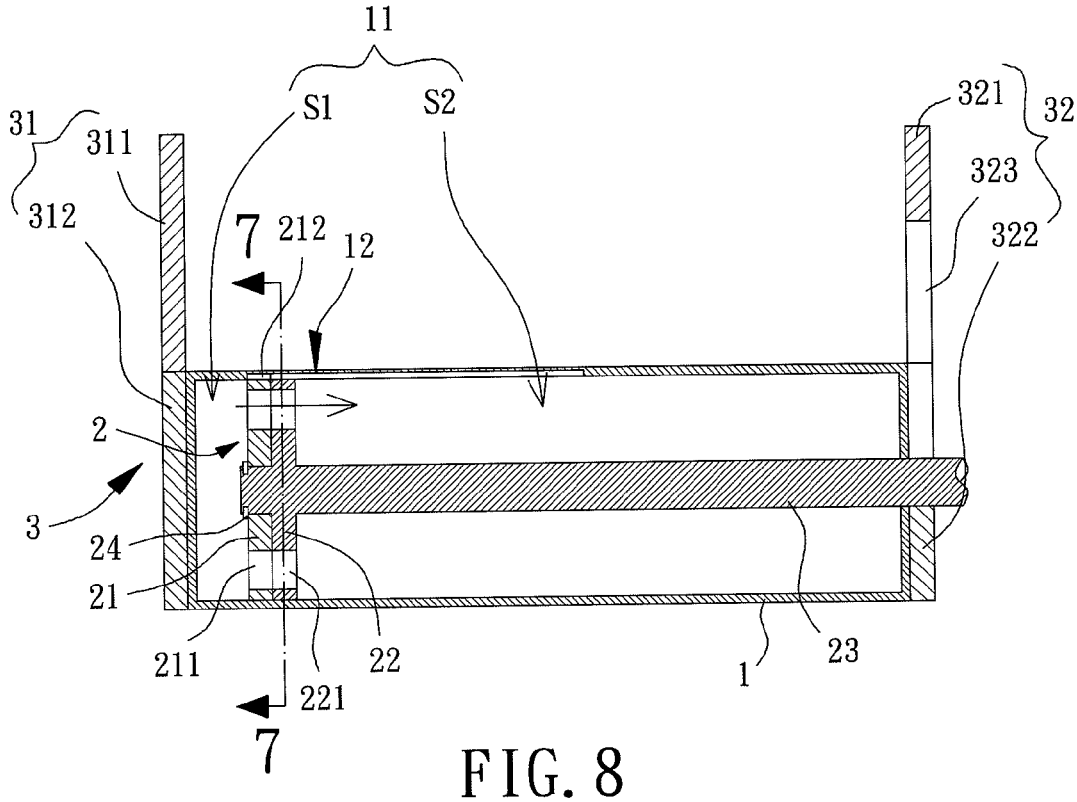
FIG. 8 shows a view similar to FIG. 4, wherein the piston assembly is to be moved in a reverse direction.

Then, the piston assembly 2 is further driven to move in a direction indicted by the arrow in FIG. 8, and the first and second pistons 21 and 22 synchronously to the right end of the cylinder 1 in FIG. 8 while the guiding block 213 moves along the longitudinal section 121*b* of the second groove section 12*b*. The gas in the compressed section S1 and the expansion section S2 momentarily produces a shockwave impact effect, and exchange of heat energy of the gas occurs, rapidly restoring the temperature in the chamber 11 and achieving a balance. The first and second regulators 31 and 32 are also driven to a position in which the insulating portions 312 and 322 of the first and second regulators 31 and 32 abutting the two sides of the cylinder 1, avoiding the ambient air temperature from interfering with the gas temperature balance in the cylinder 1.

Figure 9:
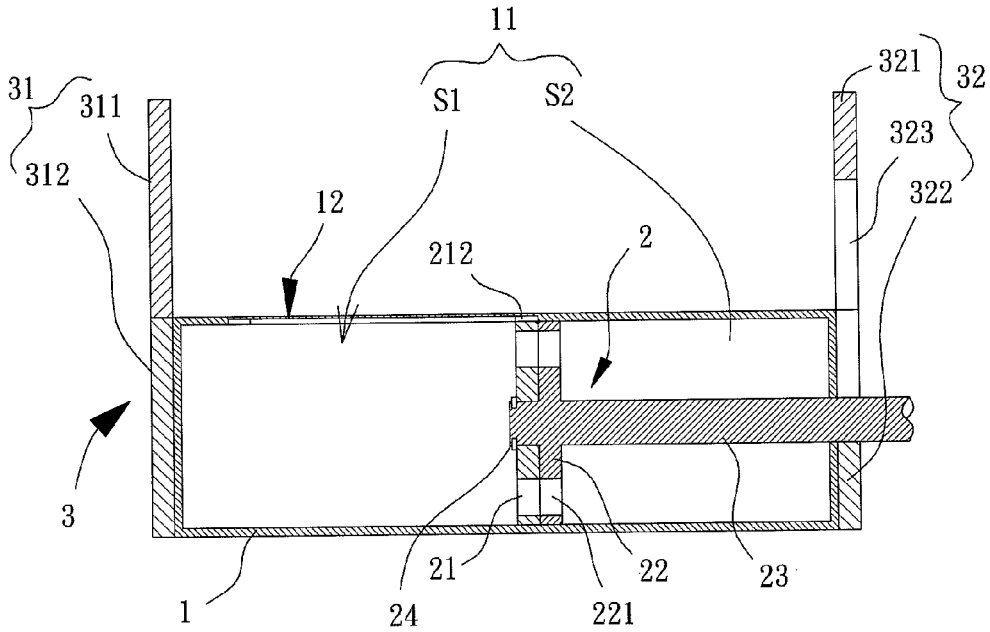
FIG. 9 shows a view similar to FIG. 8, with the piston assembly returned to its initial position shown in FIG. 4.
Figure 10:
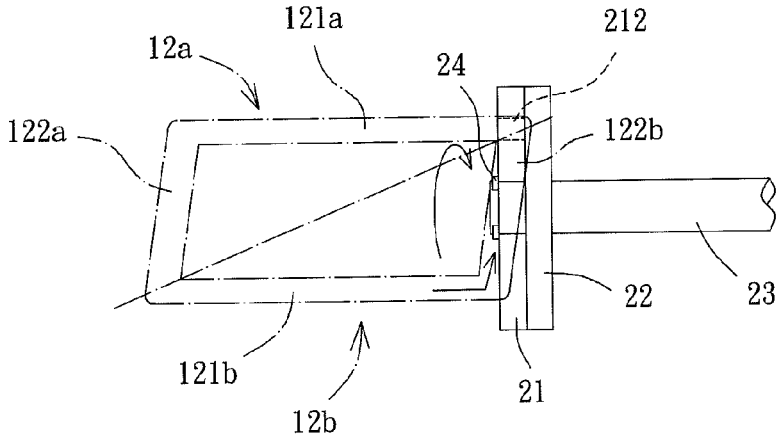
FIG. 10 shows a view similar to FIG. 6, with the guiding block moved in another transverse section of the groove and with the second piston rotated.

With reference to FIG. 9, when the piston assembly 2 moves to the intersection of the longitudinal section 121*b* and the transverse section 122*b* of the second groove section 12*a* (the right end of the groove 12 in FIG. 10), the guiding block 213 of the first piston 21 slides into the transverse section 122*b* of the second groove section 12*b*. The first block 21 rotates in a direction indicated by the arrow in FIG. 10 while the guiding block 213 slides along the transverse section 122*b* of the second groove section 12*b*. When the first piston 21 moves to the starting end of the first groove section 12*a* (i.e., the intersection of the longitudinal section 121*a* of the first groove section 12*a* and the transverse section 122*b* of the second groove section 12*b*), the openings 211 of the first piston 21 are misaligned from the openings 221 of the second piston 22. Thus, the compression section S1 and the expansion section S2 of the chamber 11 are isolated from each other again. An output procedure of the high-temperature gas and the low-temperature gas is accomplished.

When it is desired to proceed with the output procedure of the high-temperature gas and the low-temperature gas again, the piston assembly 2 is moved again in the leftward direction of FIG. 4. Namely, the guiding block 213 of the first piston 21 moves along the first groove section 21*a* again. The temperature of the gas portion in the compression section S1 is again increased by the piston assembly 2, and the temperature of the gas portion in the expansion section S2 is again reduced by the piston assembly 2. The high-temperature gas and the low-temperature gas are produced again for use in the conventional thermodynamic cycling mechanism, as mentioned above.

The main features of the heating and cooling device according to the present invention are that the cylinder 1 including the guiding groove 12 cooperates with the piston assembly 2 including first and second pistons 21 and 22, with the first piston 21 rotatable relative to the second piston 22 such that the high-temperature gas is produced in the compression section S1 and that the low-temperature gas is produced in the expansion section S1. Thus, the gas can be rapidly heated and cooled according to the present invention, producing an effect between the relatively high-temperature gas and the relatively low-temperature gas.

Furthermore, by providing the guiding block 213 formed on the outer periphery of the first piston 21 and slideable along the guiding track 12 to rotate the first piston 21, the compression section S1 becomes in communication with the expansion section S2 when the piston assembly 2 moves to an end of the cylinder 1, providing an instant impact effect by the gas to rapidly restore the gas temperature and the pressure balance in the chamber 11. Thus, the output efficiency of the high-temperature gas and the low-temperature gas can be increased while effectively maintaining the temperature difference between the high-temperature gas and the low-temperature gas. When used in a conventional thermodynamic cycling mechanism, the overall operating speed can be increased, increasing the work output efficiency and increasing the power output.

The heating and cooling device according to the present invention can rapidly heat and cool a gas to produce a high-temperature gas and a low-temperature gas. Furthermore, the heating and cooling device according to the present invention can effectively maintain a better gas temperature difference for use in a conventional thermodynamic cycling mechanism, the overall operating speed can be increased, increasing the work output efficiency and increasing the power output.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A heating and cooling device comprising:

a cylinder including a chamber having an inner periphery, with a guiding groove defined in the inner periphery of the chamber, with the chamber adapted for receiving a gas; and a piston assembly movably received in the chamber of the cylinder, with the piston assembly including first and second pistons and a connecting rod connected to the first and second pistons, with each of the first and second pistons having a first side and a second side, with the first side of the first piston abutting against the second side of the second piston, with the first piston being relative to the connecting rod, with each of the first and second pistons including a plurality of openings extending from the first side to the second side, with the first piston further including an outer periphery having a guiding block, with the guiding block slideably received in the guiding groove to rotate the first piston for aligning or misaligning the openings of the first piston with the openings of the second piston.

2. The heating and cooling device as claimed in claim 1, with the guiding groove being a closed annular groove, with the guiding groove including first and second groove sections, with each of the first and second groove sections including a transverse section and a transverse section, with the transverse section of the first groove section connected to the longitudinal section of the second groove section, with the transverse section of the second groove section connected to the longitudinal section of the first groove section, with the guiding groove being a parallelogram.

3. The heating and cooling device as claimed in claim 2, with the transverse section of the first groove section being at a first angle to the longitudinal section of the first groove section, with the transverse section of the second groove section being at a second angle to the longitudinal section of the second groove section, with each of the first and second angles being larger than 90°.

4. The heating and cooling device as claimed in claim 1, further comprising: a regulating module including first and second regulators, with the first and second regulators mounted to two sides of the cylinder, with each of the first and second regulators including a conductive portion and an insulating portion.

5. The heating and cooling device as claimed in claim 4, with the second regulator including a notch, with the notch being an elongated slit extending in a longitudinal direction of the second regulator, with the connecting rod moving in the elongated slit while the first and second pistons move in the chamber.

6. The heating and cooling device as claimed in claim 1, wherein the guiding block is arcuate.

7. The heating and cooling device as claimed in claim 1, wherein the guiding groove is in a form of a parallelogram.

* * * * *